US006490814B2

(12) United States Patent
Matis

(10) Patent No.: US 6,490,814 B2
(45) Date of Patent: Dec. 10, 2002

(54) SANDAL CONSTRUCTION AND METHOD FOR MANUFACTURING SAME

(75) Inventor: Clark A. Matis, Charlotte, VT (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

(21) Appl. No.: 09/758,079

(22) Filed: Jan. 10, 2001

(65) Prior Publication Data

US 2002/0088141 A1 Jul. 11, 2002

(51) Int. Cl.[7] ..... A43B 3/12; A43C 11/00

(52) U.S. Cl. ..... 36/11.5; 36/89; 36/114; 12/142 S

(58) Field of Search ..... 36/11.5, 12, 55, 36/89, 114, 101; 12/142 S, 142 T

(56) References Cited

U.S. PATENT DOCUMENTS

| | | | | |
|---|---|---|---|---|
| 2,407,556 | A | * | 9/1946 | Kleven |
| 2,417,776 | A | * | 3/1947 | Neunuebel |
| 2,715,285 | A | * | 8/1955 | Del Vecchio |
| 3,323,233 | A | * | 6/1967 | Scholl |
| 3,800,444 | A | * | 4/1974 | Young |
| 5,423,134 | A | * | 6/1995 | Bagnaia et al. |
| 5,533,278 | A | * | 7/1996 | Stein |
| 5,802,738 | A | * | 9/1998 | Ferniani |
| 5,896,684 | A | * | 4/1999 | Lin |
| D417,947 | S | | 12/1999 | Lavertue et al. |
| D422,402 | S | | 4/2000 | Lavertue et al. |
| 6,256,906 | B1 | * | 7/2001 | Matis et al. |

FOREIGN PATENT DOCUMENTS

FR 2595213 * 9/1987

OTHER PUBLICATIONS

Merrell Outdoor Footwear—Spring 1999, pp. 18 and 19.
Merrell Sandals—Spring, Summer 1996.
Merrell Fall 1994 Sandals.
Merrell Outdoor Footwear—Fall 1997.
Merrell—Spring 1993.
Merrell Outdoor Footwear—Fall 1999, pp. 22 and 23.
Merrell Outdoor Footwear—Spring 1998.
Merrell 1995.
Merrell Outdoor Footwear—Fall 1998.

* cited by examiner

*Primary Examiner*—M D Patterson
(74) *Attorney, Agent, or Firm*—Warner Norcross & Judd LLP

(57) ABSTRACT

A sandal construction having ankle and heel straps that are secured to the sandal by a pair of posts. Each of the posts is affixed to the sole at two laterally spaced-apart locations to provide the posts with substantial lateral stability. The posts preferably have a generally "inverted Y-shape," with an inner leg secured to the sole in a first location and an outer leg secured to the sole at a second location spaced laterally outwardly from the first location. The inner leg of the post preferably extends through a slot in the sole and is adhesively secured to the undersurface of the midsole and the outer leg preferably extends along and is adhesively secured to the side surface of the sole.

23 Claims, 8 Drawing Sheets

SANDAL CONSTRUCTION AND METHOD FOR MANUFACTURING SAME

BACKGROUND OF THE INVENTION

The present invention relates to footwear, and more particularly to a sandal construction and a method for manufacturing the same.

Sandals are available in a wide variety of constructions. Referring to FIG. 1, a conventional sandal 10 includes a strapping system 12 secured to a sole 14. The sole 14 engages the wearer's foot and forms the wear surface of the sandal 10. The strapping system 12 secures the sole 14 to the wearer's foot, typically using separate ankle 16, heel 17 and forefoot 18 straps. The ankle 16 and heel 17 straps are located in the ankle region of the sandal 10, and are adapted to securely strap about the wearer's heel and ankle. With high performance sandals, it is desirable for the ankle 16 and heel 17 straps to not only secure the sandal 10 to the wearer's ankle, but also to provide lateral ankle support. The ankle 16 and heel 17 straps can be affixed directly to the sole 14 or to conventional support members, typically called posts, extending upwardly on opposite side of the sole 14. The forefoot strap 18 is disposed in the forefoot region of the sandal 10, and is adapted to strap over the top of the wearer's foot generally in the ball region of the foot.

The straps are secured to the sole primarily using one of two different construction techniques. The first of these techniques is a stitching technique in which the lower ends of the straps or the posts are stitched directly to the sole. This construction is illustrated in FIGS. 2A–B, which show a second sandal 10' having a sole 14', an ankle strap 16', a heel strap 17' and a forefoot strap 18'. As shown, the straps are secured to the sole by a row of stitches 20. The stitches 20 extends on an angle from the upper surface of the sole 12 to the side surface of the sole 12 (See FIG. 2B). This technique is relatively inexpensive, however, it may not provide the durability needed for certain applications. Further, this technique is essentially limited to use with strap materials that are capable of being stitched, such as leather, woven or textile straps. This construction technique is not well suited for use with rigid, non-pliable materials. Because of the inherent flexible nature of conventional stitchable materials, stitched ankle strap constructions typically provide little lateral ankle support. In some applications, the stitching is replaced by staples or tacks. In general, these alternative constructions suffer from the same problems as the stitched construction.

A second technique for securing the straps to the sole is an adhesive construction in which the strap ends are cemented or adhesively secured to the sole. A conventional adhesive construction is illustrated in FIGS. 1 and 3. As shown, the sole 22 includes a midsole 24 and an outsole 26. In this type of construction, the ankle and heel straps are typically mounted atop a pair of upright portions 28 that extends up from opposite sides of the sole 22. The upright portions 28 (along with any desired lining material, such as neoprene lining 29) extend down through slots 32 in the midsole 24 and are adhesively secured to the undersurface 30 of the midsole 24. The outsole 26 is adhesively secured to the bottom surface of the midsole 24 to form the wear surface of the sole 22 and to entrap the ends of the posts 28. The adhesive construction generally provides improved durability and is well suited for use with relatively rigid post materials, such as thermoplastic elastomers. Nonetheless, this type of construction still fails to provide the lateral ankle support desired in many applications because the upright portions 28 are subject to significant lateral deflection. To reduce this lateral deflection, efforts have been made to replace or bolster the upright portions 28 with substantially rigid posts, for example, rigid polymeric components that are affixed to and extend upwardly from the sole. The ankle and heel straps can be affixed to the top of the posts or the posts can simply be secured to the upright portions to reduce their susceptibility to lateral deflection. Although an improvement over other conventional constructions in terms of lateral stiffness, conventional post constructions still fail to provide the desired lateral support for many applications.

SUMMARY OF THE INVENTION

The aforementioned problems are overcome by the present invention, which provides a sandal having a pair of rigid posts; each affixed to the sole at two distinct and laterally spaced locations. In a preferred embodiment, the posts each have a generally "inverted Y-shape," with a first leg secured to the sole in a first location and a second leg secured to the sole at a second location laterally spaced from the first location.

In a more preferred embodiment, the inner leg of the post extends through a slot in the sole and is adhesively secured to the undersurface of the midsole while the outer leg extends along and is adhesively secured to the side surface of the sole. The sole may define a recess to receive the outer leg. Securing the outer leg to the side surface of the sole rather than within a second slot provides maximum spacing between the inner and outer legs, and hence increases stability.

The present invention provides a durable sandal construction that is easily manufactured using conventional apparatus. The laterally spaced, two-point attachment of the sandal posts provides the sandal with significant lateral ankle support. The present invention also provides aesthetic benefits by permitting the post to extend down over the side surface of the sole.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 4:
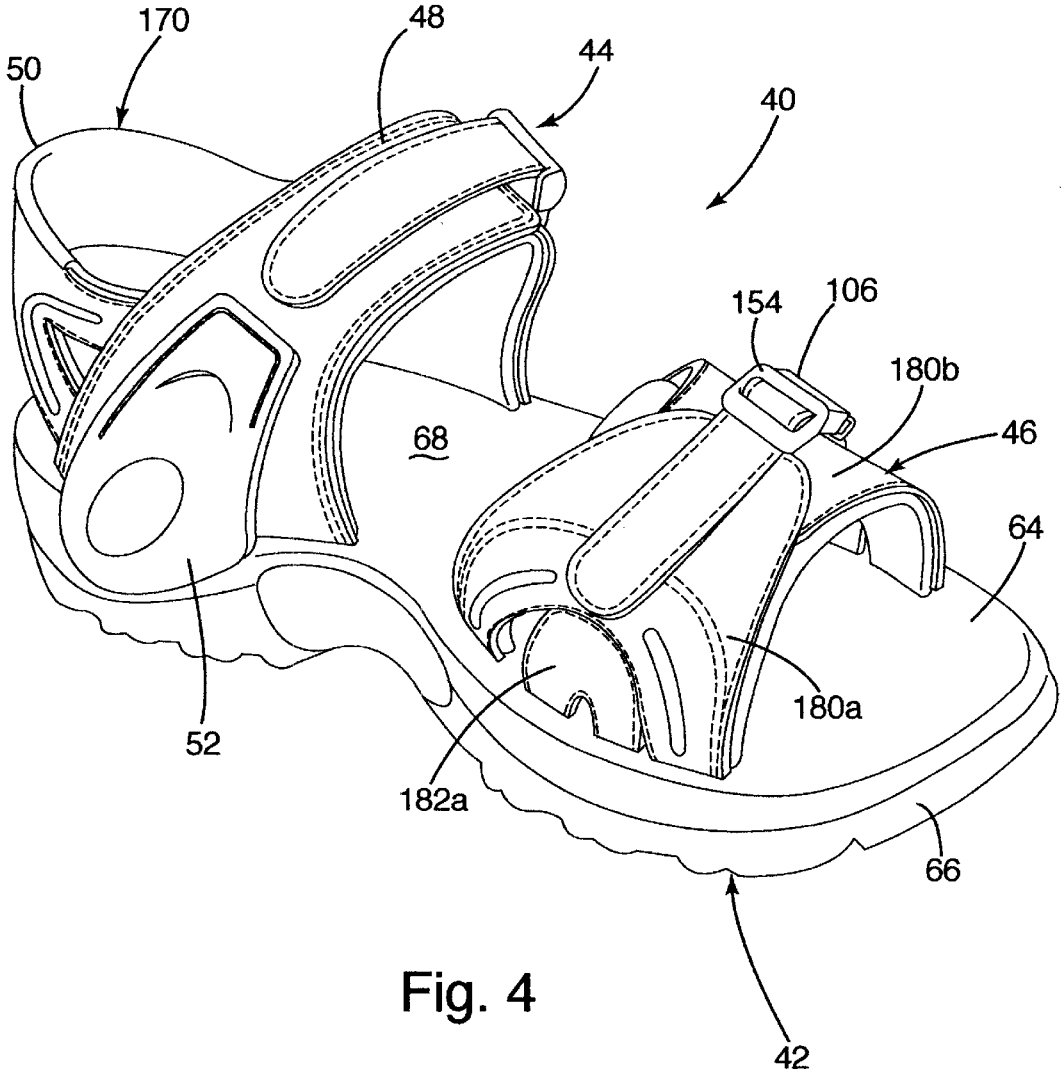
FIG. 4 is a perspective view of a sandal according to a preferred embodiment of the invention.
Figure 5:
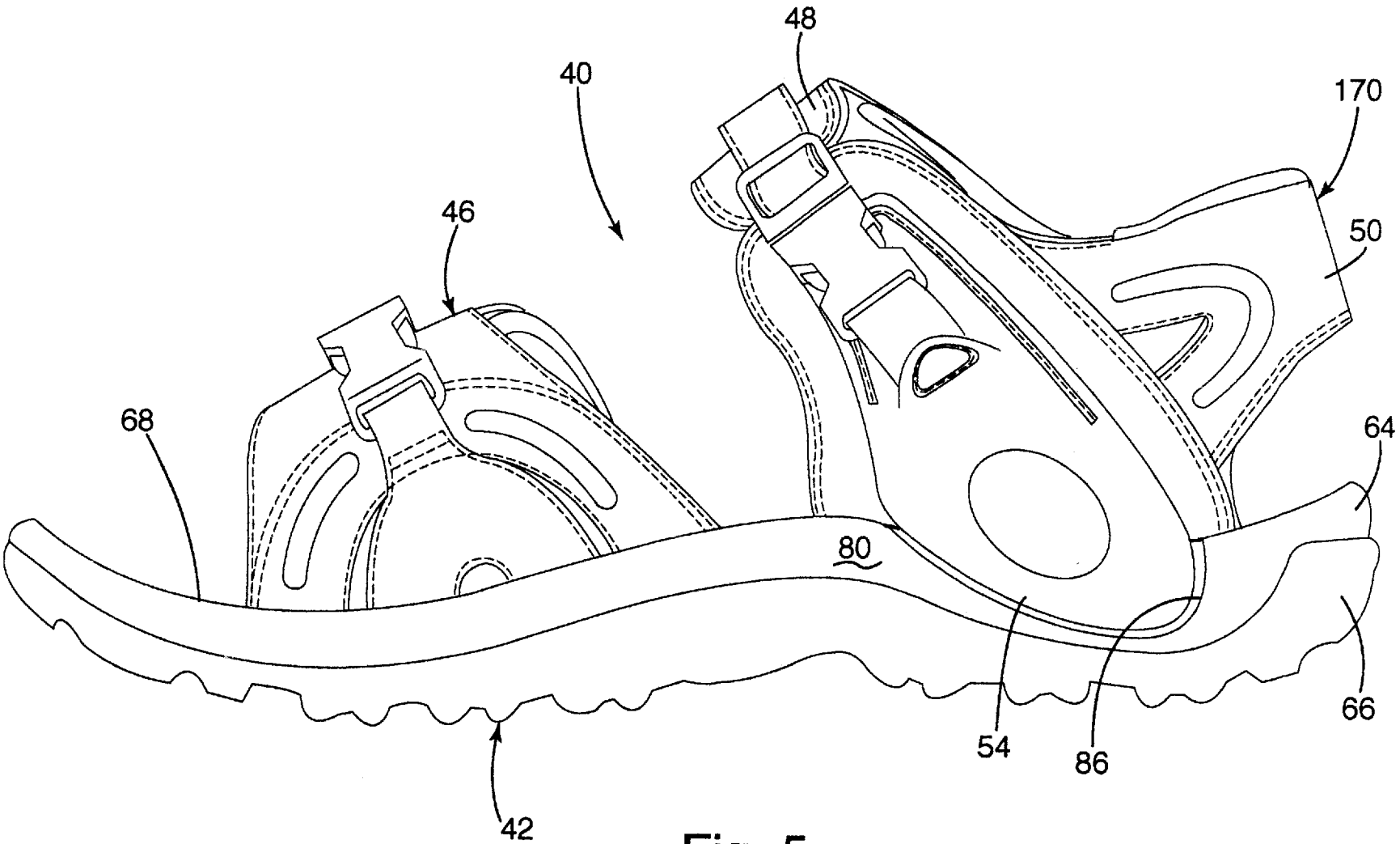
FIG. 5 is a right side elevational view of the sandal.
Figure 6:
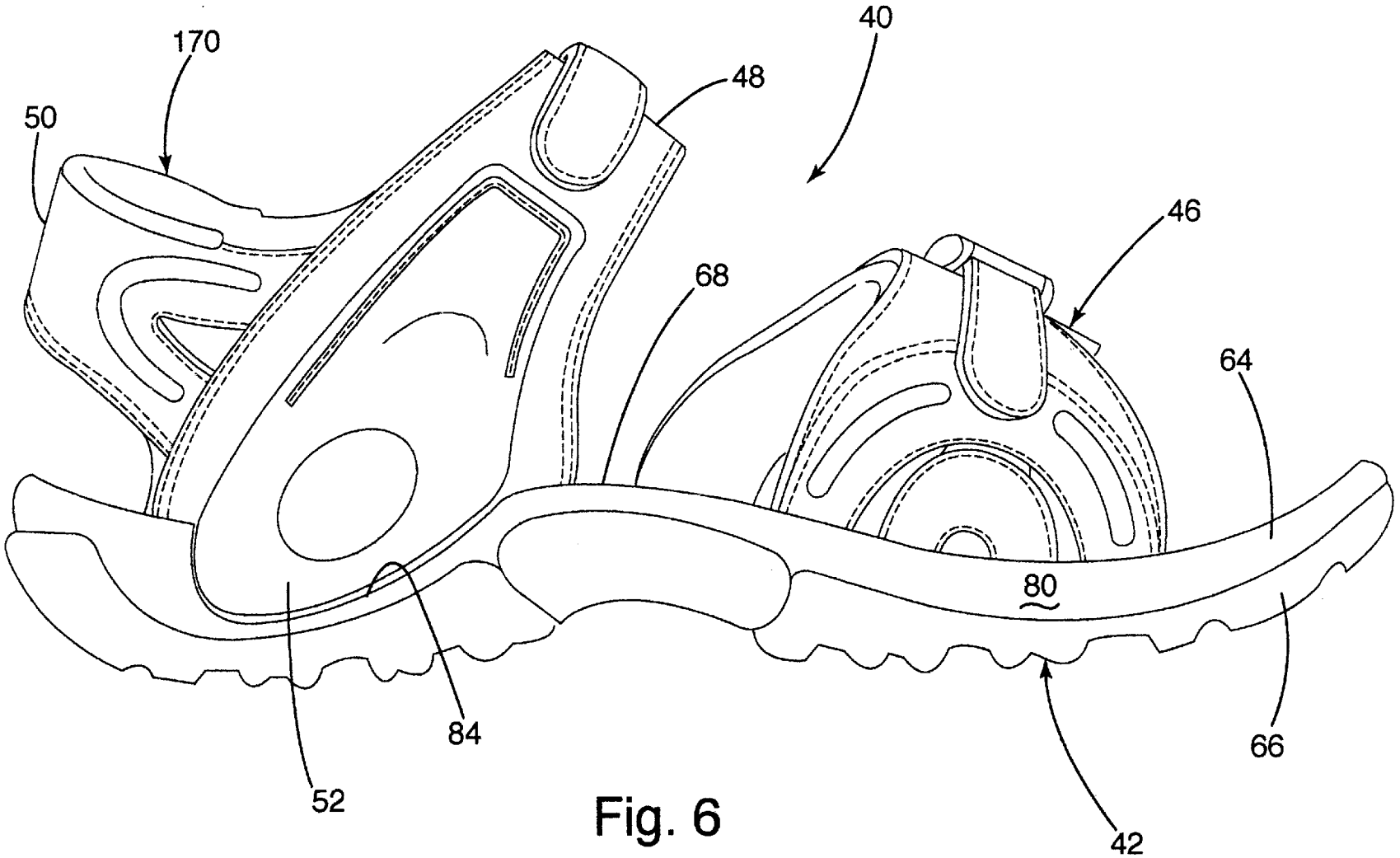
FIG. 6 is a left side elevational view of the sandal.

A sandal according to a preferred embodiment of the present invention is shown in FIG. 4, and generally designated 40. The illustrated sandal 40 is intended to be worn on the left foot. A sandal to be worn on the right foot may, of course, be the mirror image of the illustrated sandal 40. The sandal 40 includes a sole 42 and a strapping system 44 for securing the wearer's foot to the sole 42. The strapping system 44 includes a pair of posts 52, 54 that support an ankle strap 48 and a heel strap 50. The post 52 includes upright segment 58, outer leg 66 and pair of inner legs 62*a–b*. The inner legs 62*a–b* are secured to the sole 42 in laterally spaced relation from the outer leg 66. Additionally, the inner legs 62*a–b* and outer legs 66 are secured on one side of the sole, for example, the side of the sole corresponding to the medial portion of a wearer's foot, i.e., that portion extending from the middle of the width of the foot to the inside edge of the foot. Post 54 includes upright segment 56, outer leg 64, and pair of inner legs 60*a–b*. The inner legs 60*a–b* are secured to the sole 42 in laterally spaced relation from the outer leg 64. The inner legs 60*a–b* and outer leg 64 are secured on an opposite side of the sole 42, for example, the side of the sole corresponding to the lateral portion of a wearer's foot, i.e. that portion extending from the middle of the width of the foot to the outside edge of the foot. "Laterally spaced," as used herein, means that the legs are spaced at different positions across the width of the sole 42. The spaced relation of the legs provides the posts 52, 54 with substantial lateral stability, thereby providing enhanced ankle support. The present invention is described in connection with a sport sandal having a sole and strapping system that are specially configured for high performance use. The present invention is, however, well suited for use in other types of sandal constructions. In this application, the terms inner, outer, upper and lower are used to denote directions relative to the geometric center of the described component unless otherwise noted.

The sole 42 of the present invention includes a midsole 64 and an outsole 66. The midsole 64 receives the wearer's foot and is manufactured from a relatively resilient, cushioning material, such as compression molded EVA. The midsole 64 is a one-piece component that is designed to be substantially coextensive with the bottom of the wearer's foot, extending laterally and longitudinally along the sole. To provide support and comfort, the midsole 64 is shaped to match the contours of the bottom of the foot, having a raised arch and slightly concave heel and ball portions. The upper surface 68 of the midsole 64 may be textured or even contoured to reduce the likelihood of movement between the midsole 64 and the foot. For example, a gradual ridge may extend along the upper surface 68 between the ball and toe regions of the foot. The midsole 64 defines a plurality of forefoot mounting slots 70*a–h* that are configured to receive the forefoot strap 46. The forefoot mounting slots 70*a–h* are disposed adjacent to the periphery of the midsole 64 and extend entirely therethrough in a direction substantially perpendicular to the upper surface 68. The number and location of mounting slots will vary from application to application depending primarily on the construction of the forefoot strap 46. In some applications, the forefoot mounting slots can be eliminated and the forefoot strap can be secured to the midsole 64 using other conventional techniques. The midsoles 64 further defines a plurality of post mounting slots 72, 74, 76 and 78 that are adapted to receive the posts 52 and 54 as described in more detail below. As with the forefoot mounting slots 72*a–h*, the post mounting slots 72, 74, 76 and 78 are disposed adjacent to the periphery of the midsole 64 and extend entirely therethrough in a direction substantially perpendicular to the upper surface 68. If desired, the undersurface of the midsole 64 may include depressions to receive the folded-under free ends of the various strap components to make the undersurface flush after attachment of the straps components to the midsole 64, as described in more detail below. The midsole 64 includes a peripheral side surface 80. The side surface 80 preferably defines a recessed portion 82 adapted to receive the peripheral wall of the outsole 66 as well as a pair of post recesses 84 and 86 adapted to receive the outer legs of the posts 52 and 54. The side surface 80 may also include design elements to improve the aesthetic appeal of the sandal 40.

The outsole 66 mounts to the undersurface of the midsole 64 and forms the wear surface of the sandal 40. The outsole 66 is a one-piece component having an upper surface 90 that engages the undersurface of the midsole 64, a lower surface that engages the ground and a peripheral wall 94 that extends upwardly from the periphery of the outsole 66. The lower surface preferably includes cleats or treads and may be textured or roughened to improved traction. The outsole 66 is preferably manufactured from a durable material that is durable and resistant to wear.

Figure 7:
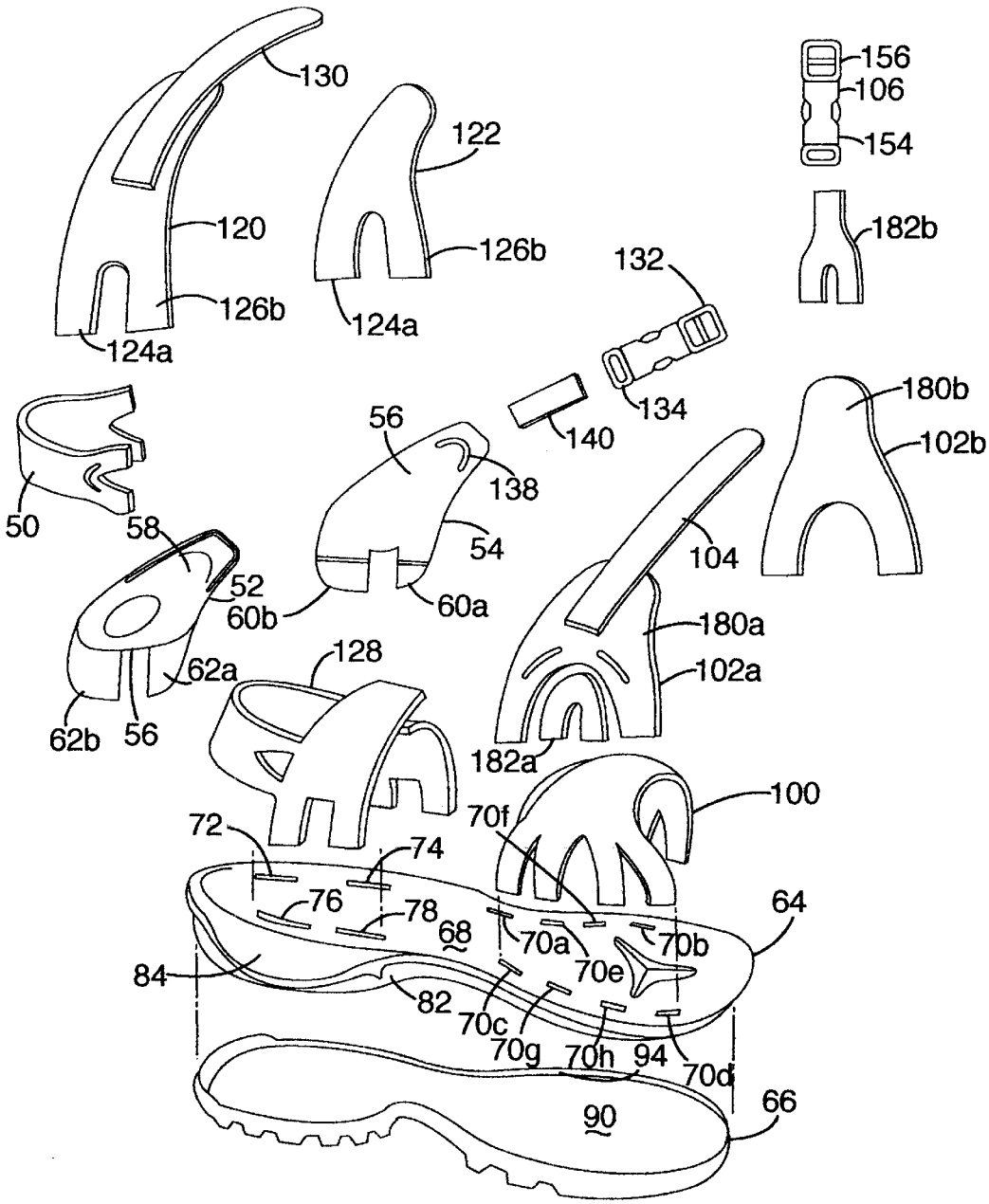
FIG. 7 is an exploded view of the sandal.
Figure 8:
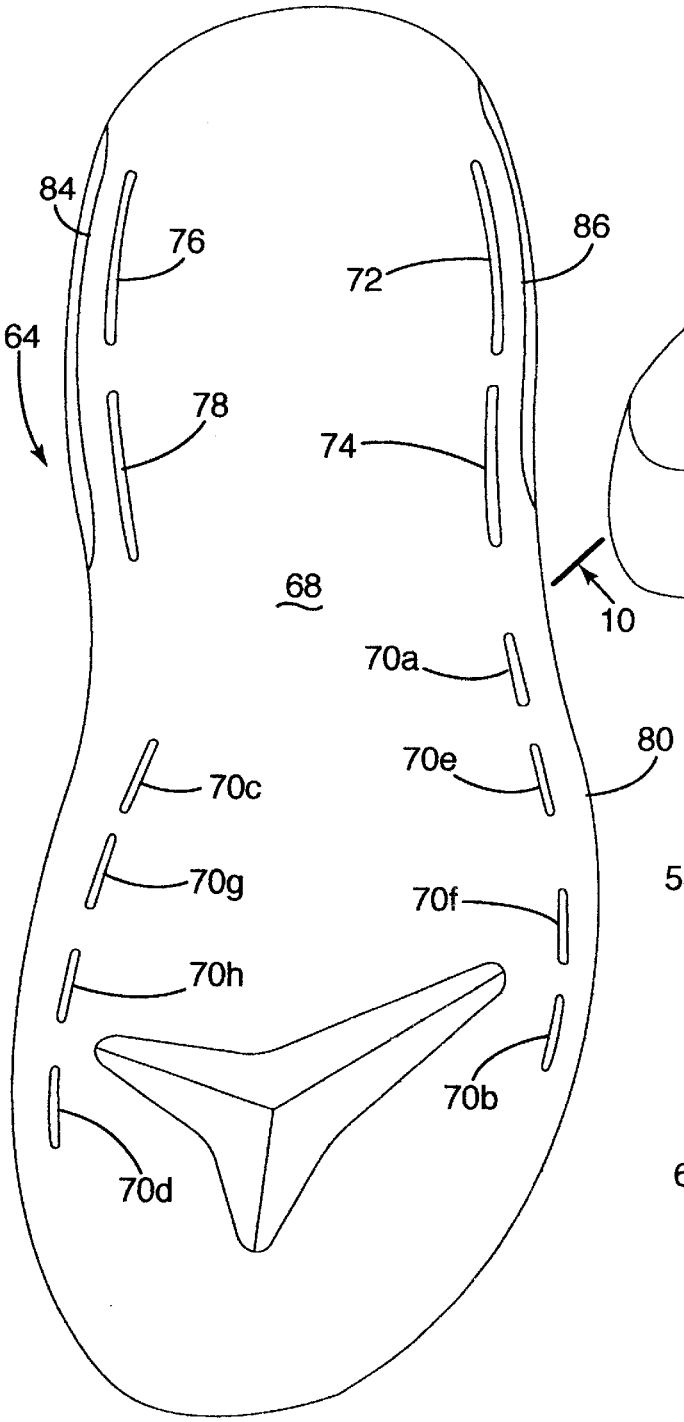
FIG. 8 is a top plan view of the midsole.

As perhaps best shown in FIG. 4, the strapping system 44 includes a forefoot strap 46 and a rear strap assembly 170. The forefoot strap 46 retains the front of the foot, or forefoot, on the sole 42. Referring now to FIG. 7, the forefoot strap 46 has a layered construction, including a neoprene lining 100, overlapping leather (or synthetic leather) flaps 102*a–b*, and an adjustable length strap 104. The flaps 102*a–b* are configured to overlap over the wearer's foot with the degree of overlap varying depending on the size of the foot. Each flap includes an inner piece 182*a–b* and an outer piece 180*a–b*. The outer pieces 18*a–b* have a generally inverted U-shape with free ends configured to extend to through the forefoot mounting slots 70*a–d* of the midsole 64 for attachment to the undersurface thereof. The inner pieces 182*a–b* also have a generally inverted U-shape, and each is configured to substantially nest within the corresponding outer piece 180*a–b*. The free ends of each inner piece 182*a–b* are configured to extend to through the forefoot mounting slots 70*e–h* of the midsole 64 for attachment to the undersurface thereof. The inner pieces 182*a–b* can be stitched to, integral with or separate from the outer pieces 180*a–b*, as desired. The lining 100 is preferably a one-piece neoprene component that extends across the forefoot of the sandal 40 inwardly from the flaps 102*a–b*. The lining 100 is preferably coextensive with all exposed inner surfaces of the flaps 102*a–b* to provide a comfortable, cushioning contact between the wearer's foot and the forefoot strap 46. The free ends of the lining 100 are adapted to extend through the forefoot mounting slots 70*a–h* to permit them to be secured to the undersurface of the midsole, as described in more detail below. The adjustable length strap 104 is sewn or otherwise affixed to outer piece 180*a*. The strap 104 extends across the sandal 40 and then doubles-back onto itself. The strap 104 may include hook-and-loop fasteners to hold down the doubled-back portion. If desired, the adjustable strap 104 can be integral with the inner piece 180*a*. The forefoot strap 46 includes a conventional clip closure 106 for quickly securing the adjustable length strap to inner piece 182*b*, thereby securing the forefoot strap 46. The clip closure 106 includes a first connector 154 that is secured to inner piece 182*b* by looping the inner piece 182*b* through the first connector 154 and stitching the inner piece 182-*b* back against itself. The clip closure 106 also includes a second connector 156 that is movably secured to the adjustable length strap 104. The connector 156 can be moved along the strap member 158 to adjust the length, and thus the fit, of the forefoot ankle strap 46. FIG. 7 shows the clop closure 106 with the first connector 154 and second connector 156 interconnected.

Referring again to FIG. 4, the rear strap assembly 170 includes an ankle strap 48, a heel strap 50 and a pair of posts 52 and 54. The ankle strap 48 and heel strap 50 are preferably integrated into a single component. As shown in FIG. 7, the ankle strap 48 preferably includes a medial flap 120 and a lateral flap 122. The flaps 120 and 122 preferably include split free ends 124*a–b* and 126*a–b* that extend through post mounting slots 72, 74, 76 and 78. The ankle strap 48 also preferably includes an adjustable length strap 130 that is secured to the medial flap 120, preferably by stitching. The rear strap assembly 170 preferably includes a clip closure 129 for securing the adjustable strap 130. The clip closure 129 preferably includes a first connector 132 that is movably mounted to the adjustable strap 130 and a second connector 134 that is fixedly secured to exterior post 54. The first 132 and second 134 connectors snap connect to quickly and easily secure the rear strap assembly 170. The adjustable strap 130 preferably extends across the sandal 40, loops through the connector 132 and then doubles-back onto itself. The connector 132 can be moved along the strap 130 to adjust the length of the ankle strap 48 and consequently the fit of the rear strap assembly. The adjustable strap 130 preferably includes hook-and-loop fasteners to hold down the doubled-back portion. The heel strap 50 is preferably secured to flaps 120 and 122, for example, by stitching. Alternatively, the ankle strap 48 and the heel strap 50 can be cut from the appropriate material as a single piece. A conventional lining 128, such as neoprene, preferably covers the exposed inner surfaces of the ankle strap 48 and heel strap 50. The lining 128 preferable extends through the post mounting slots 72, 74, 76 and 78 and is secured to the undersurface of the midsole 64. The ankle strap 48 and heel strap 50 are preferably manufactured from real or synthetic leather, but can be manufactured from other conventional materials.

Figure 1:
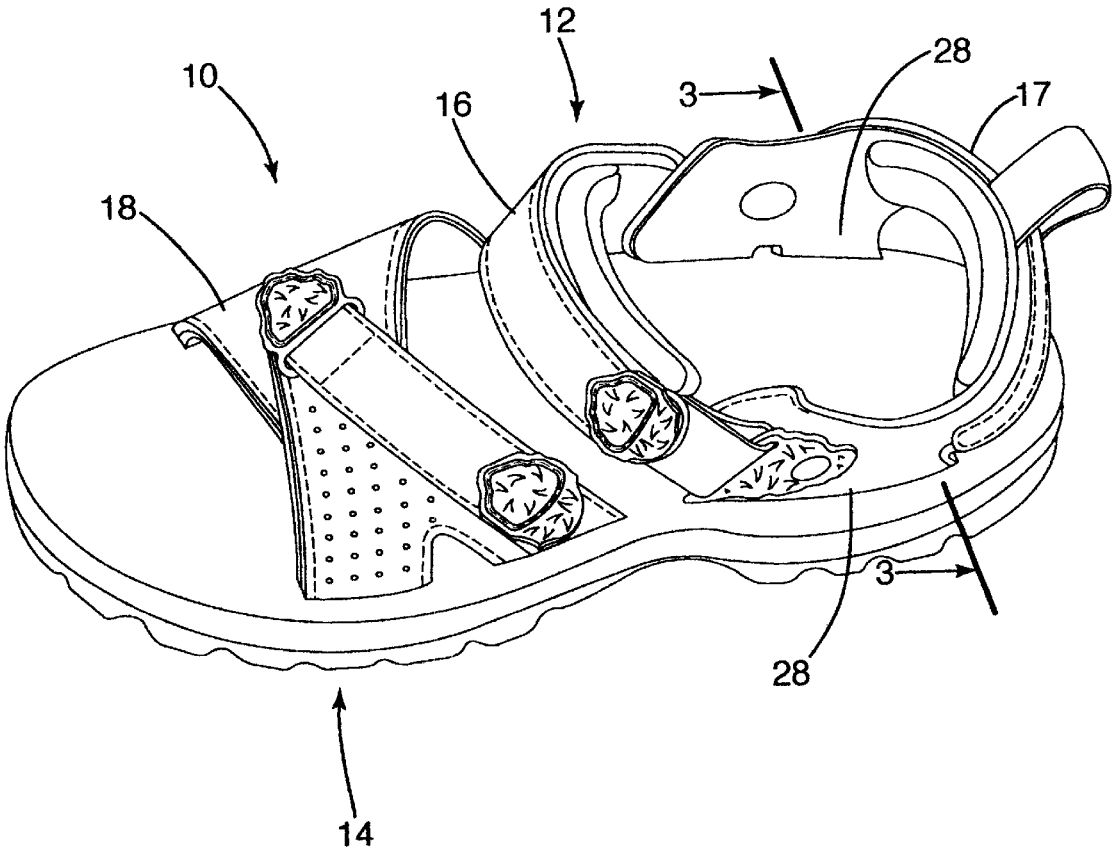
Fig. 1 (Prior Art)
FIG. 1 is a perspective view of a first sandal according to the prior art.
Figure 2A:
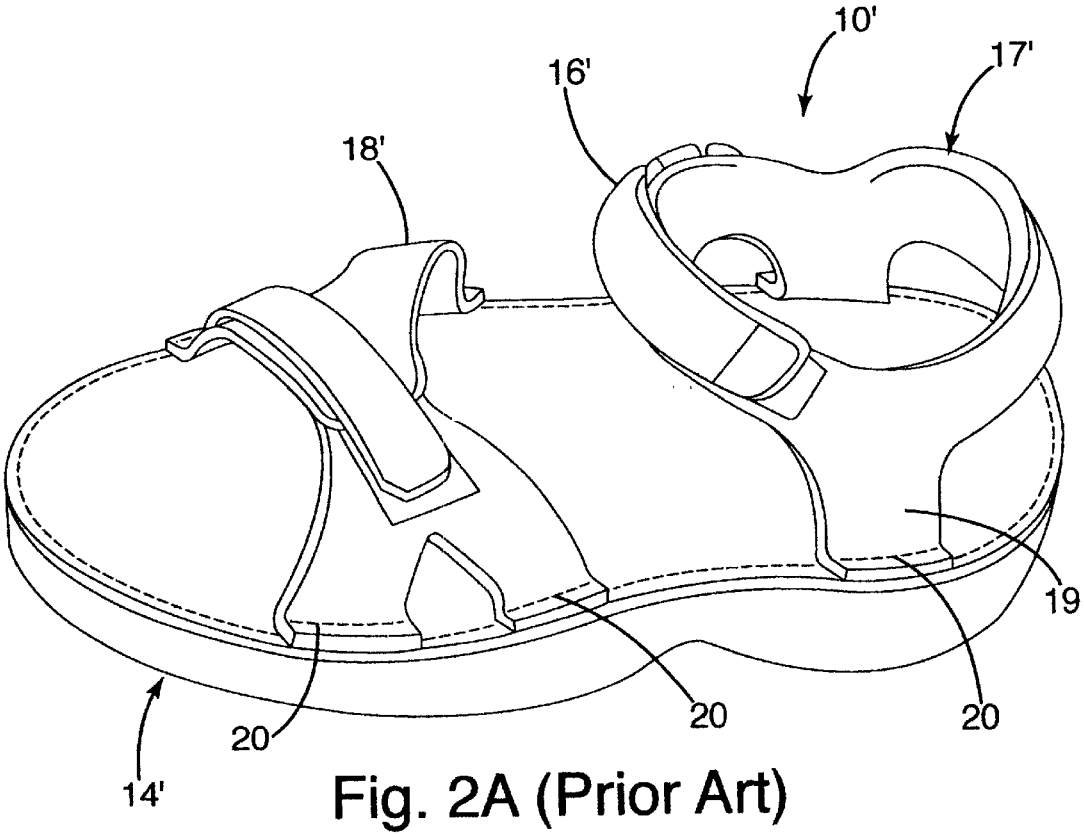
Fig. 2A (Prior Art)
FIG. 2A is a perspective view of a second sandal according to the prior art.
Figure 2B:
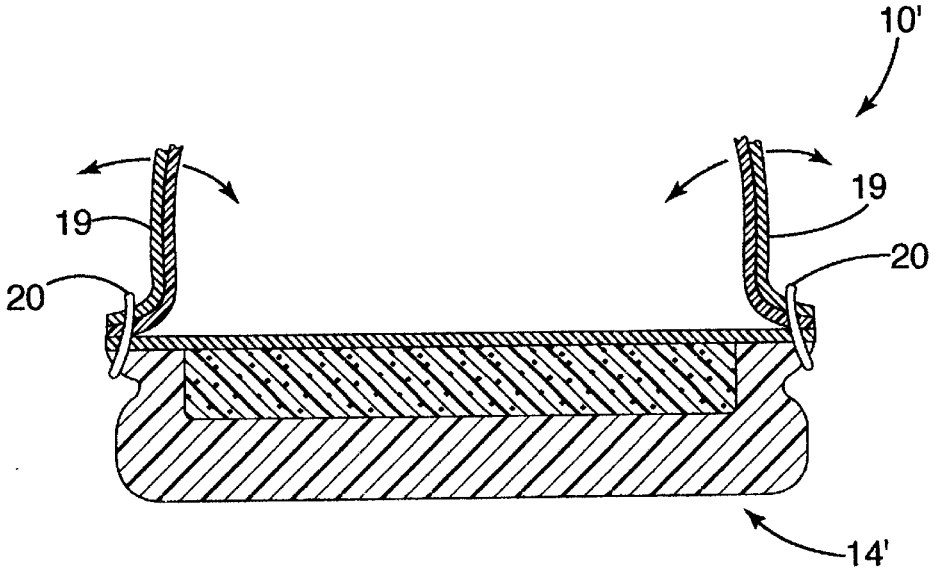
Fig. 2B (Prior Art)
FIG. 2B is a sectional view of the prior art sandal taken along line IIB—IIB of FIG. 2A.
Figure 3:
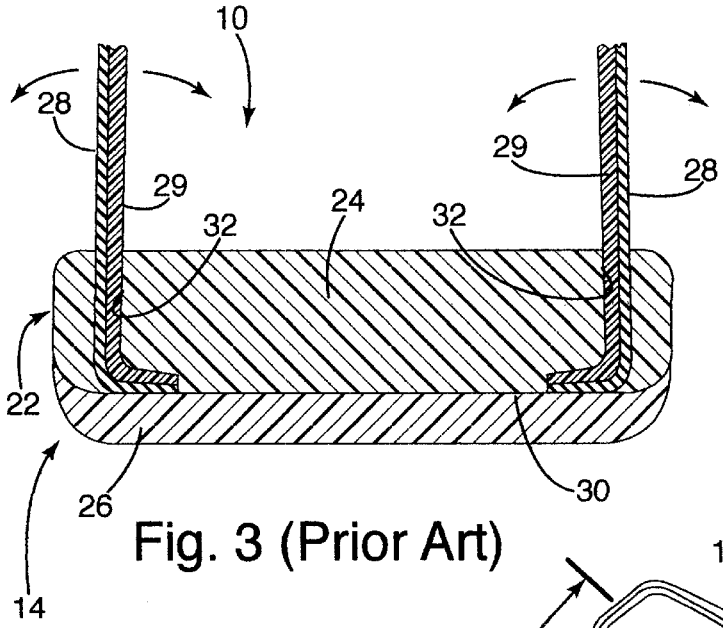
Fig. 3 (Prior Art)
FIG. 3 is a sectional view of the first prior art sandal construction taken along line III—III of FIG. 1.
Figure 12:
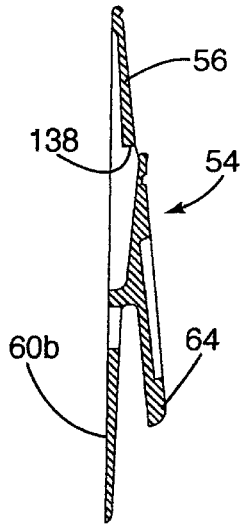
FIG. 12 is a sectional view of the interior post taken along line XII—XII of FIG. 11.
Figure 11:
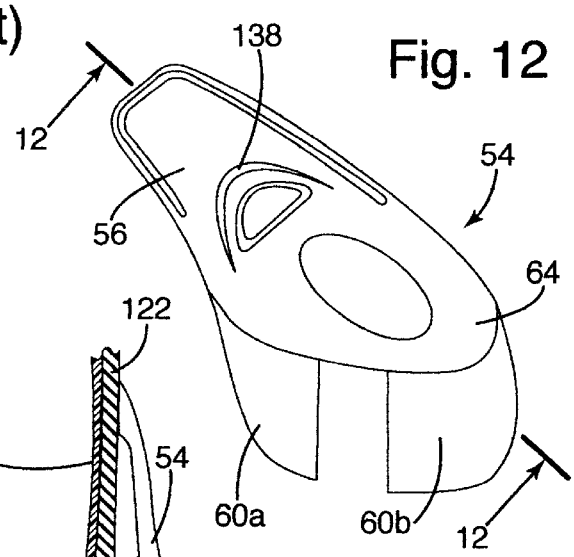
FIG. 11 is a side elevational view of the interior post.
Figure 13:
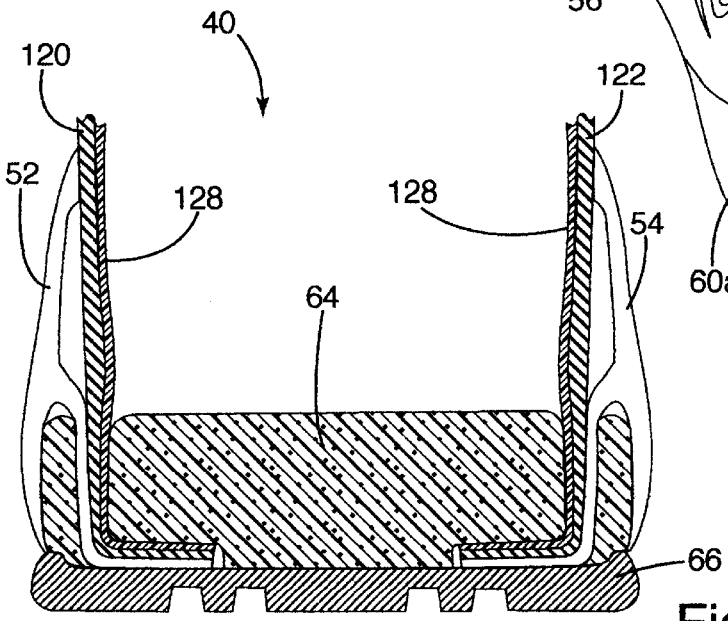
FIG. 13 is a sectional view of the sandal taken along line XIII—XIII of FIG. 4.
Figure 9:
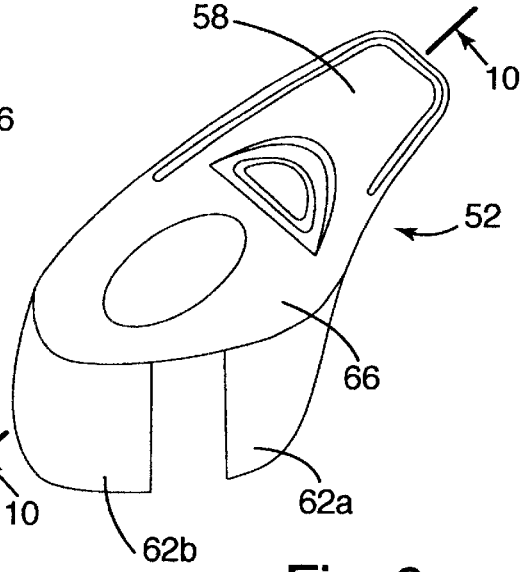
FIG. 9 is a side elevational view of the exterior post.
Figure 10:
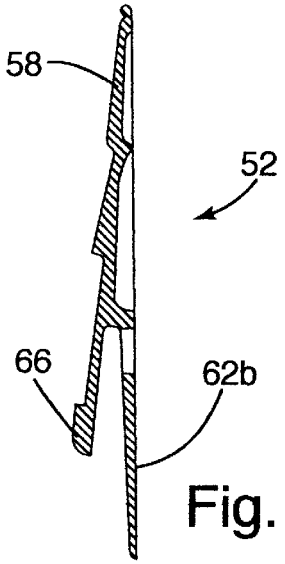
FIG. 10 is sectional view of the exterior post taken along line X—X of FIG. 9.

As noted above, the ankle strap 48 and heel strap 50 are supported by posts 52 and 54. The interior post 52 supports the interior or medial ends of the ankle strap 48 and heel strap 50, and is disposed adjacent the interior or medial edge of the sandal 40 (See FIG. 13). The exterior post 54 supports the exterior or lateral ends of the ankle strap 48 and heel strap 50, and is disposed adjacent the exterior or lateral edge of the sandal 40 (See FIG. 13). The posts 52 and 54 will be described in more detail with reference to FIGS. 9–10, which show the interior post 52, and FIGS. 11–12, which show the exterior post 54. The interior post 52 is substantially a mirror image of the exterior post 54 except that it is configured to receive one end of the ankle strap 48. More specifically, the exterior post 54 differs primarily in that it defines a narrow slot 138 that facilitates attachment of the connector 134 to the exterior post 54. As described in more detail below, a strap 140 is looped through connector 134 and then sewn to the post 54 to hold the connector 134 for mating interaction with the connector 132 of adjustable strap 130. The interior post 54 includes an upright segment 56 extending upwardly from a pair of inner legs 60*a–b* and an outer leg 64. Similarly, the exterior post 54 includes an upright segment 58 extending upwardly from a pair of inner legs 62*a–b* and outer leg 66. The inner legs 60*a–b* and 62*a–b* extend through the corresponding post mounting slots 72, 74, 76 and 78, and are folded against the undersurface of the midsole 64. The inner legs 60-*a–b* and 62*a–b* are preferably cemented or otherwise attached directly to the undersurface of the midsole 64. The outer legs 64 and 66 are cemented or otherwise secured within the corresponding post recesses 84 and 86.

Manufacture and Assembly

A preferred method for manufacturing and assembling the sandal 40 will now be described in more detail. The sandal 40 is preferably manufactured using generally conventional techniques and apparatus. With regard to the forefoot strap 46, the inner 180*a–b* and outer 182*a–b* pieces of the flaps 102*a–b* and the adjustable length strap 104 are cut from conventional materials, such as real or synthetic leather. Mating pieces of hook-and-loop fasteners can be secured to the strap 104 as desired. The adjustable length strap 104 is stitched or otherwise secured to the outer piece 180*a*. The first connector 154 of the snap connector 106 is attached to the inner piece 182*b* by looping the inner piece 182*b* through the first connector 154 and then stitching the inner piece 182*b* back onto itself, as described above. The second connector 156 is attached to the adjustable length strap 104 by looping the strap 104 through the second connector 156. The lining 100 is cut from neoprene or other conventional lining material, and preferably covers all exposed undersurfaces of the forefoot strap 46. The inner 182*a–b* and outer 180*a–b* pieces can be sewn or otherwise attached to the lining 100. Preferably, the inner pieces 182*a–b* are stitched to the lining 100 around their entire periphery and the outer pieces 180*a–b* are stitched to the lining 100 only near their lower ends. The inner piece 182*b* is preferably stitched directly to outer piece 180*b*, while inner piece 182*a* is preferably not stitched directly to the outer piece 180*a* and is instead connected to the outer piece 180a only by virtue of their common attachment to the lining 100.

The ankle strap 48 and heel strap 50 are preferably manufactured from conventional materials, such as real or synthetic leather. The heel strap 50 and the medial flap 120 and lateral flap 122 of the ankle strap 48 are cut and stitched together to form an integral component. The adjustable strap 130 is cut and secured to the medial flap 120, preferably by stitching. Mating pieces of hook-and-loop fasteners can be secured to the strap member 158 as desired. The adjustable strap 130 is preferably looped through the connector 132. The lining 128 is cut and stitched to the undersurface of the ankle strap 48 and the heel strap 50, preferably covering all exposed undersurfaces. Additional conventional cushioning and lining materials can be added to the ankle and heel straps as desired.

The posts 52 and 54 are injection molded using conventional techniques and apparatus. The posts 52 and 54 are preferably molded from conventional polymeric materials, however, the material is preferably pliable enough to permit the posts 52 and 54 to be stitched to the medial and lateral flaps without pre-forming stitch holes in the posts 52 and 54. Nylon 66 has been found to be particularly well suited for manufacturing the posts 52 and 54. Slots 138 is preferably formed as an integral part of the molding process, but can be cut afterwards, if desired. As noted above, the connector 134 is attached to post 54 by a short strap 140. The strap 140 is cut and looped through connector 134. The free ends of the strap 140 are secured to the post 54, preferably by a single row of stitching extending along stitch groove 164. The interior post 52 is secured to the medial flap 120, preferably by a single row of stitching extending along stitch groove 160. Similarly, the exterior post 54 is secured to the lateral flap 122, preferably by a single row of stitching extending along stitch groove 162. As a result, the ankle strap 48, heel strap 50, lining 128 and posts 52 and 54 become a single rear strap assembly 170.

The midsole 64 is manufactured using conventional injection molding techniques and apparatus. As noted above, the midsole 64 is preferably molded from a conventional midsole material, such as compression molded EVA. The forefoot mounting slots 70*a–h* and post mounting slots 72, 74, 76 and 78 are preferably cut into the midsole 64 after molding. They can, however, be formed as an integral part of the molding process, for example, through the use of mold pins or other mold inserts.

The forefoot strap 46 is attached to the midsole 64 by passing the free ends of the flaps 102*a–b*, end portions 150*a–b* and lining 100 through the corresponding forefoot strap mounting slots 70*a–h*. The free ends of the various components are then folded up and secured to the undersurface of the midsole 64, preferably using cement or other conventional adhesives. Similarly, the rear strap assembly 170 is attached to the midsole 64 by passing the inner legs 60*a–b* and 62*a–b* of the posts 52 and 54 along with the attached flaps 102*a–b* and lining 128 through the corresponding post mounting slots 72, 74, 76 and 78. The free ends of the various components of the rear strap assembly 170 are then folded up and secured to the undersurface of the midsole 64, preferably using cement or other conventional adhesives. The outer legs 64 and 66 are also secured to the midsole 64 within corresponding post recesses 84 and 86, preferably by cement or other conventional adhesives.

The outsole 66 is preferably molded from rubber or other conventional outsole materials using conventional molding techniques and apparatus. The outsole 66 is preferably cemented or otherwise adhesively secured to the undersurface of the midsole 64, covering not just the midsole 64, but also the free ends of the various strap components that were previously secured to the undersurface of the midsole 64.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A sandal comprising:

a midsole having a heel region and a forefoot region and first and second sides, corresponding to opposite sides of a user's foot;

a first post secured to and extending upwardly from said midsole in at least one of said heel region and said forefoot region on said first side, said first post including a first inner leg mounted to said midsole at a first location on said first side and an outer leg mounted to said midsole at a second location on said first side, said second location being laterally spaced from said first location on said first side, said first post being substantially rigid to provide stability to the ankle of a wearer; and a strap mounted to said first post for retaining a wearer's foot.

2. The sandal of claim 1 further comprising:

a second post secured to and extending upwardly from said midsole in at least one of said heel region and said forefoot region on said second side, said second post including an inner leg mounted to said midsole at a first location on said second side and a second outer leg mounted to said midsole at a second location on said second side, said second location being laterally spaced from said first location on said second side; and wherein said strap is mounted to and extends between both of said first post and said second post.

3. The sandal of claim 2 wherein said first post and said second post are located in said heel region on opposite side of said midsole.

4. The sandal of claim 3 wherein said midsole defines a post mounting slot, at least one of said first and second inner legs extending through said post mounting slot and being secured to an undersurface of said midsole.

5. The sandal of claim 4 wherein said midsole includes a side surface, at least one of said first and second outer legs being secured to said side surface of said midsole.

6. The sandal of claim 5 wherein said midsole defines a leg recess in said side surface, at least one of said first and second outer legs being disposed and secured to said midsole within said leg recess.

7. A sandal comprising:

a midsole having a heel region and a forefoot region and first and second sides corresponding to opposite sides of a user's foot;

a first post secured to and extending upwardly from said midsole in at least one of said heel region and said forefoot region on said first side, said first post including a first inner leg mounted to said midsole at a first location on said first side and a first outer leg mounted to said midsole at a second location on said first side, said second location being laterally spaced from said first location on said first side;

a strap mounted to said first post for retaining a wearer's foot;

wherein said midsole defines a post mounting slot, at least one of said first and second inner legs extending through said post mounting slot and being secured to an undersurface of said midsole; and wherein said strap includes a free end extending through said mounting slot and being secured to said undersurface of said midsole.

8. The sandal of claim 7 further comprising a lining secured to an inner surface of said strap, said lining including a free end extending through said mounting slot and being secured to the underface of said midsole.

9. A sandal comprising:

a midsole having an upper surface, a lower surface, a first side corresponding to one side of a wearer's foot, and a second side corresponding to another side of a wearer's foot opposite the first side;

a first post secured to and extending upwardly from said midsole on said first side, said first post including a first leg mounted to said midsole at a first location on said first side and a second leg mounted to said midsole at a second location on said first side, said second location being laterally spaced from said first location on said first side, said first post being substantively rigid to provide ankle support to a wearer;

a strap mounted to said first post for securing a wearer's foot in engagement with said upper surface of said midsole; and an outsole secured to said lower surface of said midsole.

10. The sandal of claim 9 wherein said midsole defines a post mounting slot on said first side, said first leg of said post extending through said post mounting slot and being secured to said lower surface of said midsole.

11. The sandal of claim 10 wherein said midsole includes a side surface, said second leg of said post being secured to said side surface of said midsole.

12. The sandal of claim 11 wherein said midsole defines a leg recess in said side surface, said second leg of said post being disposed and secured to said midsole within said leg recess.

13. A sandal comprising:

a midsole having an upper surface, a lower surface, a first side corresponding to one side of a wearer's foot, and a second side corresponding to another side of a wearer's foot opposite the first side;

a first post secured to and extending upwardly from said midsole, on said first side said first post including a first leg mounted to said midsole at a first location on said first side and a second leg mounted to said midsole at a second location on said first side, said second location being laterally spaced from said first location on said first side;

a strap mounted to said first post for securing a wearer's foot in engagement with said upper surface of said midsole;

an outsole secured to said lower surface of said midsole;

wherein said midsole defines a post mounting slot on said first side, said first leg of said post extending through said post mounting slot and being secured to said lower surface of said midsole; and wherein said strap includes a free end extending through said mounting slot and being secured to said undersurface of said midsole.

14. The sandal of claim 13 further comprising a lining secured to an inner surface of said strap, said lining including a free end extending through said mounting slot and being secured to the undersurface of said midsole.

15. The sandal of claim 14 further comprising a second post mounted to said midsole on said second side of said midsole, said second post including a first leg mounted to said midsole at a first location on said second side and a second leg mounted to said midsole at a second location on said second side, said second location being laterally spaced from said first location on said second side.

16. A method for manufacturing a sandal, comprising the steps of:

providing a substantially rigid post having first and second legs;

securing the first leg to a midsole having a first side and a second side, each corresponding to opposite sides of a wearer's foot, at a first location on said first side;

securing the second leg to the midsole at a second location on said first side, the second location being laterally spaced from said first location on said first side wherein the post supports a wearer's ankle; and mounting a strap to the post.

17. The method of claim 16 wherein the midsole includes a mounting slot; and said first securing step includes the steps of inserting the first leg through the mounting slot and affixing the first leg to an undersurface of the midsole.

18. The method of claim 17 wherein the midsole includes a side surface; and said second securing step includes the step of affixing the second leg to the side surface of the midsole.

19. The method of claim 18 wherein the midsole defines a recess in the side surface and said second securing step including the steps of fitting the second leg within the recess and affixing the second leg to the midsole within the recess.

20. The method of claim 19 wherein said mounting step includes the step of stitching the strap to the post.

21. A method for manufacturing a sandal, comprising the steps of:

providing a substantially rigid post having first and second legs;

securing the first leg to a midsole having a first side and a second side, each corresponding to opposite sides of a wearer's foot, at a first location on said first side, said first securing step including the sub steps of inserting the first leg through the mounting slot and affixing the first leg to an undersurface of the midsole;

securing the second leg to the midsole at a second location on said first side, the second location being laterally spaced from said first location on said first side;

mounting a strap to the post wherein the strap includes a free end;

wherein the midsole includes a mounting slot; and passing the free end through the mounting slot and affixing the free end to the undersurface of the midsole.

22. The method of claim 21 further comprising the steps of:

providing a second post having first and second legs;

securing the first leg of the second post to the midsole at a first location on said second side;

securing the second leg of the second post to the midsole at a second location on said second side, the second location being laterally spaced from said first location on said second side; and mounting the strap to the second post.

23. A method of manufacturing a sandal, comprising the steps of:

providing a midsole having lateral and medial sides;

attaching a lateral post to the midsole, the lateral post having a first leg and a second leg, the first leg being affixed to the midsole in a first location on said lateral side, the second leg being affixed to the midsole in a second location on said lateral side, the second location being laterally spaced apart from the second location on or adjacent said lateral side;

attaching a medial post to the midsole, the medial post having a first leg and a second leg, the first leg being affixed to the midsole in a first location on said medial side, the second leg being affixed to the midsole in a second location on said medial side, the second location being laterally spaced apart from the second location on or adjacent said medial side; and securing a strap to the lateral post and the medial post wherein said lateral post and said medial post are substantially rigid to provide support to the ankle of a wearer.

* * * * *